United States Patent [19]

Tureaud

[11] Patent Number: 4,523,580

[45] Date of Patent: Jun. 18, 1985

[54] APPARATUS FOR TREATING HUMAN FEET

[76] Inventor: Aloysius K. Tureaud, 213 E. Washington, Ann Arbor, Mich. 48104

[21] Appl. No.: 373,905

[22] Filed: May 3, 1982

[51] Int. Cl.[3] ..... A61H 1/02

[52] U.S. Cl. ..... 128/52; 128/25 B; 128/66

[58] Field of Search ..... 128/24, 25 R, 25 B, 128/51-53, 65, 66, 365, 369, 368

[56] References Cited

U.S. PATENT DOCUMENTS

| | | | |
|---|---|---|---|
| 2,206,902 | 7/1940 | Kost . | |
| 2,956,565 | 10/1960 | Anderson | 128/369 |
| 3,055,357 | 9/1962 | Redka . | |
| 3,543,747 | 12/1970 | Gustafson . | |
| 3,577,985 | 5/1971 | Guffin . | |
| 3,742,941 | 7/1973 | Aizenstat . | |
| 3,762,402 | 10/1973 | Abramovitz . | |
| 3,768,461 | 10/1973 | Taylor . | |
| 3,774,598 | 11/1973 | Wilson et al. | 128/52 |
| 3,789,836 | 2/1974 | Girten . | |
| 3,830,232 | 8/1974 | McNair . | |
| 3,881,471 | 5/1975 | Grube . | |
| 3,939,825 | 2/1976 | Krummenacher | 128/52 |
| 3,942,520 | 3/1976 | McNair . | |
| 4,019,502 | 4/1977 | Elkins . | |
| 4,057,053 | 11/1977 | Kunz . | |
| 4,165,737 | 8/1979 | Chapa . | |
| 4;214,576 | 7/1980 | Henley | 128/24.1 |

FOREIGN PATENT DOCUMENTS

| | | | |
|---|---|---|---|
| 2056959 | 5/1972 | Fed. Rep. of Germany | 128/25 B |
| 1513564 | of 1967 | France | 128/25 B |

*Primary Examiner*—Richard J. Apley
*Assistant Examiner*—David J. Brown
*Attorney, Agent, or Firm*—Krass & Young

[57] ABSTRACT

Apparatus for treating human feet includes a container adapted to hold a quantity of liquid into which the feet may be immersed. A pair of foot supports within the container are alternately reciprocated to effect foot massage. The supports include fins which turbulently circulate the liquid to enhance the massage. A quantity of particulates such as sand may be introduced into the liquid in order to further enhance the massage and provide mild abrasion of the skin to remove callouses and the like.

2 Claims, 5 Drawing Figures

Fig-3
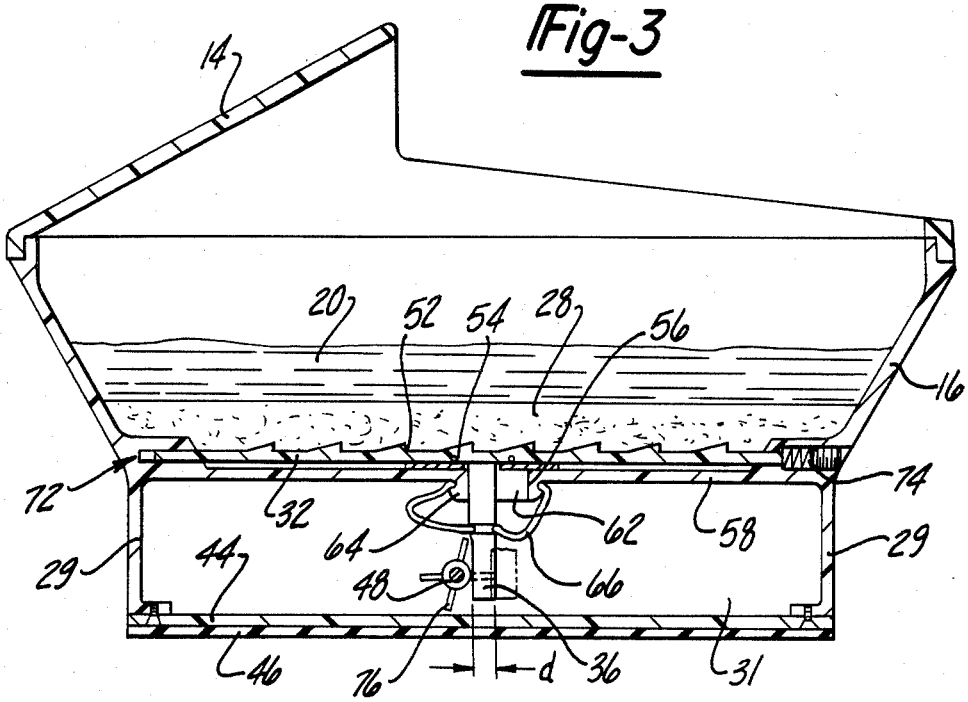
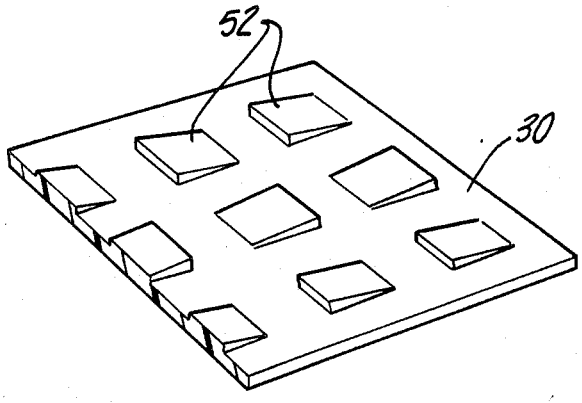
Fig-4
Fig-5
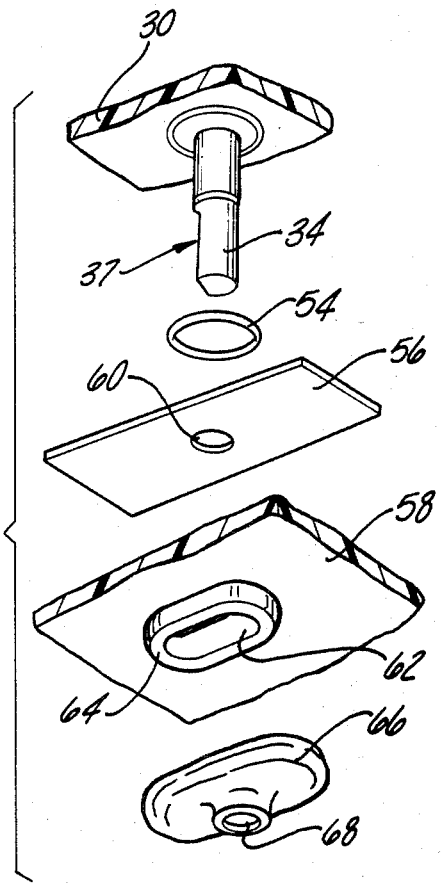

APPARATUS FOR TREATING HUMAN FEET

DESCRIPTION

1. Technical Field

The present invention broadly relates to massage apparatus and deals more particularly with a device for soothing and massaging human feet.

2. Background Art

Various types of apparatus have been devised in the past for relieving discomfort of the human feet. Some of these devices include a container adapted to be filled with water and into which the feet may be immersed to aid in relaxing and soothing the feet. A rotary type vibrator connected to a planar support upon which the feet rests provides rapid oscillatory motion characteristic of conventional massage devices.

Foot massage devices of the type described above are less than completely effective in providing total relief because of the type of massaging action which is applied to the feet. Moreover, these devices merely stimulate the bottoms of the feet and do not impart soothing action to upper portions of the feet.

It is therefore a primary object of the present invention to overcome each of the difficiencies mentioned above.

A still further object of the invention is to provide a foot massage device which not only provides improved stimulation to the bottoms of the feet but also massages the top of the feet.

A still further object of the invention is to provide a foot massage device as described above which generates turbulent motion of a fluid in which the feet are immersed.

Another object of the invention is to provide a device as described above which includes circulating particulates for enhancing the massage effect and for providing abrasion of the skin in order to remove callouses and the like.

These, and further objects of the invention will be made clear or will become apparent during the course of the following description of a preferred embodiment of the invention.

DISCLOSURE OF THE INVENTION

In accordance with the present invention, apparatus for treating human feet includes a container adapted to hold a quantity of liquid into which the feet may be immersed. A pair of supports upon which the feet may be rested are disposed within the container below the level of the liquid. The supports are mounted for reciprocating movement in an alternate manner relative to each other. Each of the supports comprise a plate member having a plurality of fin elements thereon which displace water during reciprocation of the plates to produce turbulent motion of the liquid which aids in the massage effect. A quantity of particulates, such as sand, may be introduced into the liquid for increasing the massage effect on upper portions of the feet.

BRIEF DESCRIPTION OF THE DRAWINGS

In the drawings, which form an integral part of the specification and are to be read in conjunction therewith, and in which like reference numerals are employed to designate identical components of the various views:

FIG. 3 is a sectional view taken along the line 3—3 of FIG. 2;

FIG. 4 is a fragmentary, perspective view of a portion of one of the foot supports; and, FIG. 5 is a perspective, exploded view showing the mounting relationship between one of the foot supports and the bottom wall of the container.

BEST MODE FOR CARRYING OUT THE INVENTION

Figure 1:
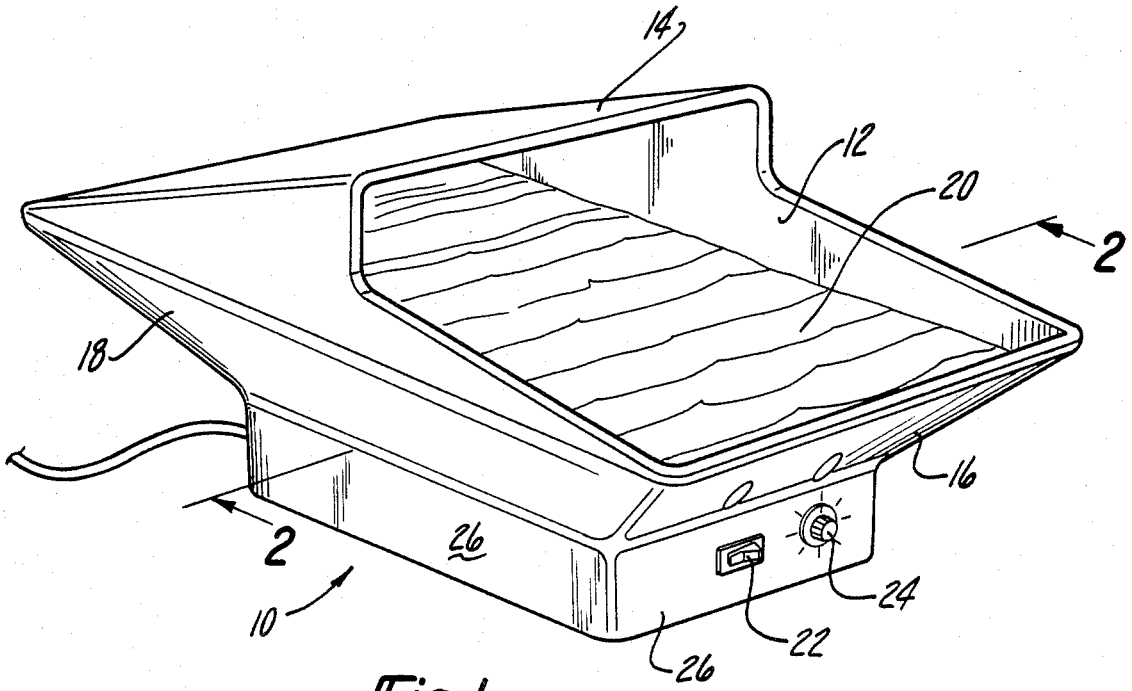
FIG. 1 is a perspective view of apparatus for treating human feet which comprises the preferred embodiment of the present invention.
Figure 2:
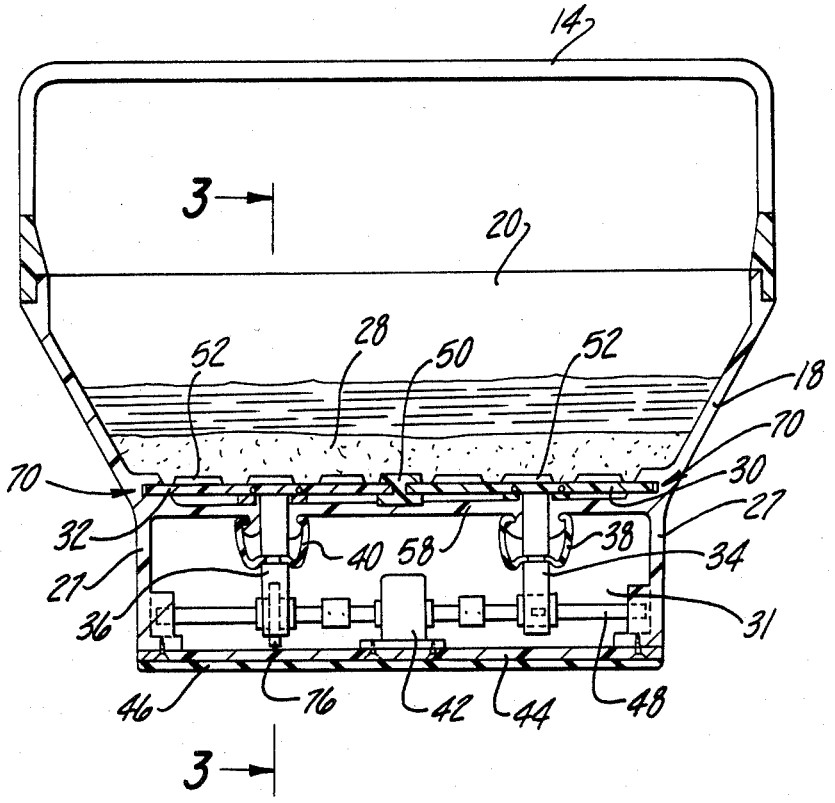
FIG. 2 is a sectional view taken along the line 2—2 of FIG. 1.

Referring to the drawings, the present invention is broadly concerned with a device, generally indicated by the numeral 10, for treating human feet. The device 10 includes a container 26 adapted to hold a quantity of liquid 20, such as hot water. Container 26 is defined by a pair of end walls 16, sidewalls 18 and a bottom wall 58 constructed of plastic by molding techniques or the like. The container 26 further includes lower side wall portions 27 and lower end wall portions 29 as well as a pair of base plates 44 and 46 which collectively define an enclosure 31 beneath the bottom wall 58.

A hood 14 may be provided which extends approximately one half of the container 26 to avoid splashing of the liquid 20 to the surrounding environment.

A pair of essentially rectangular, flat foot supports in the nature of plates 30 and 32 are spaced immediately above the bottom wall 58 and are mounted for reciprocating movement longitudinally within the container 26 by means of a central slotted support 50 and slots 70 defined in sidewalls 18. Plates 30 and 32 are provided with a plurality of alternately oriented fins 52 on the upper surface thereof whose purpose will become later apparent.

Bottom wall 58 includes a pair of spaced apart, elongate slots 62 therein through which a pair of respectively associated cam lugs 34 and 36 extend. The upper portions of cam lugs 34 and 36 are respectively secured to the bottom surfaces of plates 30 and 32. A flexible O-ring 54 and mounting plate 56 having an aperture 60 therein are sleeved over each of the lugs 34, 36 so as to provide a smooth, sliding surface between the bottom of plates 30, 32 and bottom wall 58. A flexible boot 66, made of rubber or the like, provided with an aperture 68 is mounted on a lip 64 surrounding slot 62 on the lower surface of bottom wall 58 so as to provide a fluid tight seal between the lugs 34, 36 and bottom wall 58.

Each of the lugs 34, 36 is provided with a camming surface 37 on one side thereof which is adapted to be engaged by a later discussed cam.

A pair of compression springs 74 mounted in the front wall 16 of the container 26, and in registration with plates 30, 32 bear against the forward edge of such plates and therefore bias the latter toward the rear of the device 10.

Means for driving the plates 30, 32 to reciprocate include an electric motor 42 mounted on base 44 within enclosure 31 and having an output drive shaft 48 journalled for rotation in opposite faces of lower sidewall portions 27. A pair of camming members are mounted on shaft 48 in registration with cam lugs 34 and 36, and each include a pair of cam lobes 76 which are positioned on shaft 48 so as to alternately engage and cam lugs 34; in this manner, the plates 30, 32 are driven to alternately reciprocate relative to each other against the biasing influence of springs 74.

Motor 42 may be of conventional design and is energized by means of a switch 22. A conventional speed control 24 may be provided to vary the speed of the motor 42 and thus control the intensity of the massage effect provided by plates 30, 32.

In operation, the container 26 is filled with a quantity of liquid, such as hot water, and the feet are immersed into the liquid and supported respectively on plates 30, 32. A quantity of particulates 28, such as sand or the like may be introduced into the liquid 20. The particulates 28 may be abrasive to the skin, if desired.

Fins 52 on plates 30, 32 provide massage action on the bottom of the feet and also function to displace liquid at the bottom of the container 26 (via fins 52) so as to produce turbulent motion of the liquid. The particulates 28 are carried by the turbulent motion of the liquid 20 into colliding contact with the upper portions of the feet. Depending upon the abrasive qualities of the particulates 28, the ensuing collision is effective in removing outer layers of the skin, thus aiding in the reduction of callouses and the like.

From the foregoing, it is apparent that the device described above not only provides for the reliable accomplishment of the objects of the invention, but does so in a particularly effective and economical manner. It is recognized, of course, that those skilled in the art may make various modifications or additions to the preferred embodiment chosen to illustrate the invention without departing from the spirit and scope of the present contribution to the art. Accordingly, it is to be understood that the protection sought and to be afforded hereby should be deemed to extend to the subject matter claimed and all equivalents thereof fairly within the scope of the invention.

I claim:

1. Apparatus for treating human feet comprising:

a container to hold a quantity of liquid into which said feet may be immersed;

a pair of horizontally disposed support plates within said container and each adapted to individually support a human foot thereon;

fin means on the upper surface of each of said support plates for massaging engagement with the bottom of said feet;

means mounting said support plates for reciprocating movement relative to each other within said liquid;

a quantity of particulates within said container and circulated by displacement of said liquid for colliding with said feet; and drive means connected with said support plates for causing said plates to relatively reciprocate whereby said feet are relatively reciprocated in said container on said plates and said liquid and particulates are turbulized by the mutually reciprocal movement of said feet and said fins so that said fins massage the bottoms of said feet and the turbulized liquid and particulates massage and abrade the upper regions of said feet to provide total foot massage and total abrasive cleansing of said feet.

2. The apparatus of claim 1, wherein said particulates include surface areas which are abrasive to said feet.

* * * * *